US012171312B2

(12) United States Patent
Cazalet et al.

(10) Patent No.: US 12,171,312 B2
(45) Date of Patent: Dec. 24, 2024

(54) QUICK RELEASE BAND/LUG MECHANISM FOR SMARTWATCH

(71) Applicant: Google LLC, Mountain View, CA (US)

(72) Inventors: Peter Michael Cazalet, Los Gatos, CA (US); Christoph Gredler, Mountain View, CA (US); Eric Dayringer, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 603 days.

(21) Appl. No.: 17/506,109

(22) Filed: Oct. 20, 2021

(65) Prior Publication Data

US 2023/0119270 A1 Apr. 20, 2023

(51) Int. Cl.
*A44C 5/14* (2006.01)

(52) U.S. Cl.
CPC ..... *A44C 5/14* (2013.01); *A44C 5/147* (2013.01)

(58) Field of Classification Search
CPC .. A44C 5/14; A44C 5/147; A44C 5/00; G04B 37/05; G04B 37/16
See application file for complete search history.

(56) References Cited

U.S. PATENT DOCUMENTS 3,165,884 A * 1/1965 Gwinner ..... G04B 37/14 368/282
11,553,767 B2 * 1/2023 Cazalet ..... G04B 37/1446
2010/0302913 A1* 12/2010 Loiseau ..... G04B 37/0427 368/316
2017/0258186 A1* 9/2017 Schooley ..... G04B 37/1486
2020/0019120 A1* 1/2020 Gauche ..... G04B 45/0092
2020/0209807 A1* 7/2020 Lazzari ..... G04B 37/1486
2020/0383434 A1 12/2020 Chung et al.
2020/0405017 A1* 12/2020 Hu ..... G04B 37/1486
2021/0085041 A1* 3/2021 Schlichtig ..... G04B 37/22
2021/0177107 A1* 6/2021 Cazalet ..... A44C 5/14

FOREIGN PATENT DOCUMENTS

CN 111528586 A 8/2020

* cited by examiner

*Primary Examiner* — Edwin A. Leon
*Assistant Examiner* — Jason M Collins
(74) *Attorney, Agent, or Firm* — Lerner David LLP

(57) ABSTRACT

A watch system may include a watchband including a flexible member configured to be mounted onto a wrist of a user, and a puck including watch functionality. The watchband may have an end that has a concave curved shape. The puck may have a connection interface that has a convex curved shape. The connection interface may be to be removably coupled to the end of the watchband. The watchband and the puck may have corresponding locking features that are configured to rotationally and translationally fix the puck to the watchband. The corresponding locking features may be configured to be engaged when the watchband is translated relative to the puck and rotated relative to the puck by a predetermined rotation angle.

20 Claims, 5 Drawing Sheets

QUICK RELEASE BAND/LUG MECHANISM FOR SMARTWATCH

BACKGROUND

The mass appeal of a smartwatch depends upon how well it can meet the needs of the user, not only from a functional standpoint, but also in terms of comfort over a wide population of wrist sizes and shapes, a variety of customizable aesthetic styles, and the ability to quickly change these styles depending upon the activity of the user. The ability to quickly change the bands and lugs of a smartwatch enables appealing user features while minimizing the number of required SKUs. A problem with smartwatches with quickly changeable bands and/or lugs is that most quick release mechanisms for bands occupy a lot of room in the body of the device, reducing room that is needed for functional systems, or making the overall device larger than the user wants to wear.

BRIEF SUMMARY

One aspect of the disclosure provides for a watch system. The watch system may include a watchband comprising a flexible member configured to be mounted onto a wrist of a user, the watchband having an end that has a concave curved shape, and a puck including watch functionality, the puck having a connection interface that has a convex curved shape, the connection interface configured to be removably coupled to the end of the watchband. The watchband and the puck may have corresponding locking features that are configured to rotationally and translationally fix the puck to the watchband, the corresponding locking features configured to be engaged when the watchband is translated relative to the puck and rotated about a central axis of the puck by a predetermined rotation angle.

The corresponding locking features may include a plurality of watchband teeth that are configured to be engaged with a corresponding plurality of puck teeth, such that the puck teeth may prevent the watchband teeth from translating away from the puck. Each of the puck teeth may extend circumferentially about the central axis of the puck by a same angle, and the same angle may be about equal to the predetermined rotation angle. The corresponding locking features may include a release button adjacent to the connection interface of the puck, the release button being configured to abut a side surface of the end of the watchband, such that the release button may prevent the end of the watchband from rotating relative to the puck.

The watch system may have an engaged configuration in which the end of the watchband is rotationally locked relative to the puck by interference between the side surface of the end of the watchband and a side surface of the release button, and in which the end of the watchband is translationally locked relative to the puck by interference between the wristband teeth and corresponding ones of the puck teeth. The release button may be biased by a spring element towards an extended position in which the release button abuts the side surface of the end of the watchband, so that the release button may be configured to automatically move from a depressed position within the puck to the extended position when the end of the watchband is moved off of the release button.

The watch system may also include a spring element disposed within the connection interface, the spring element being configured to push the end of the watchband away from the puck, so that the watchband teeth may apply a continual force against the puck teeth. The end of the watchband may be a first end and the connection interface may be a first connection interface. The watchband may also have a second end that has a concave curved shape and a second connection interface that has a convex curved shape, and the second connection interface may be configured to be removably coupled to the second end of the watchband. The predetermined rotation angle may be between about 5° and about 20°. The puck may have smartwatch features including a display, sensors, and a battery.

Another aspect of the disclosure provides for method of removably coupling a watchband to a puck, the puck having watch functionality. The method may include providing the watchband comprising a flexible member configured to be mounted onto a wrist of a user, the watchband having an end that has a concave curved shape. The method may include translating the end of the watchband towards the puck until the end of the watchband contacts a connection interface of the puck, the connection interface having a convex curved shape, and rotating the end of the watchband about a central axis of the puck in a first rotational direction by a predetermined rotation angle. The method may include engaging corresponding locking features of the watchband and the puck during the translating and the rotating of the end of the watchband, the corresponding locking features rotationally and translationally fixing the watchband to the puck.

The translating of the end of the watchband may include inserting the end of the watchband into the connection interface of the puck, such that a plurality of watchband teeth may move between a corresponding plurality of puck teeth. The rotating of the end of the watchband may include aligning the plurality of the watchband teeth with the corresponding plurality of puck teeth, such that the puck teeth may prevent the watchband teeth from translating away from the puck. Each of the puck teeth may extend circumferentially about the central axis of the puck by a same angle, and the same angle may be about equal to the predetermined rotation angle.

The translating of the end of the watchband may include the end of the watchband contacting and depressing a release button adjacent to the connection interface of the puck, and the rotating of the end of the watchband may include moving the end of the watchband off of the release button so that the release button may automatically move to an extended position in which the release button abuts a side surface of the end of the watchband, such that the release button may prevent the end of the watchband from rotating relative to the puck. After the rotating of the end of the watchband, the watch system may be in an engaged configuration in which the end of the watchband is rotationally locked relative to the puck by interference between the side surface of the end of the watchband and a side surface of the release button, and in which the end of the watchband is translationally locked relative to the puck by interference between the wristband teeth and corresponding ones of the puck teeth.

The method may also include detaching the watchband from the puck. The detaching may include depressing the release button so that the side surface of the release button no longer abuts the side surface of the end of the watchband, rotating the end of the watchband relative to the puck in a second rotational direction opposite the first rotational direction by the predetermined rotation angle, and translating the end of the watchband away from the puck until the end of the watchband is withdrawn from the connection interface of the puck. The method may also include, after rotating the end of the watchband, a spring element disposed within the connection interface pushing the end of the watchband away from the puck, so that the watchband teeth may apply a continual force against the puck teeth. The predetermined rotation angle may be between about 5° and about 20°. The puck may have smartwatch features including a display, sensors, and a battery.

DETAILED DESCRIPTION

Figure 1:
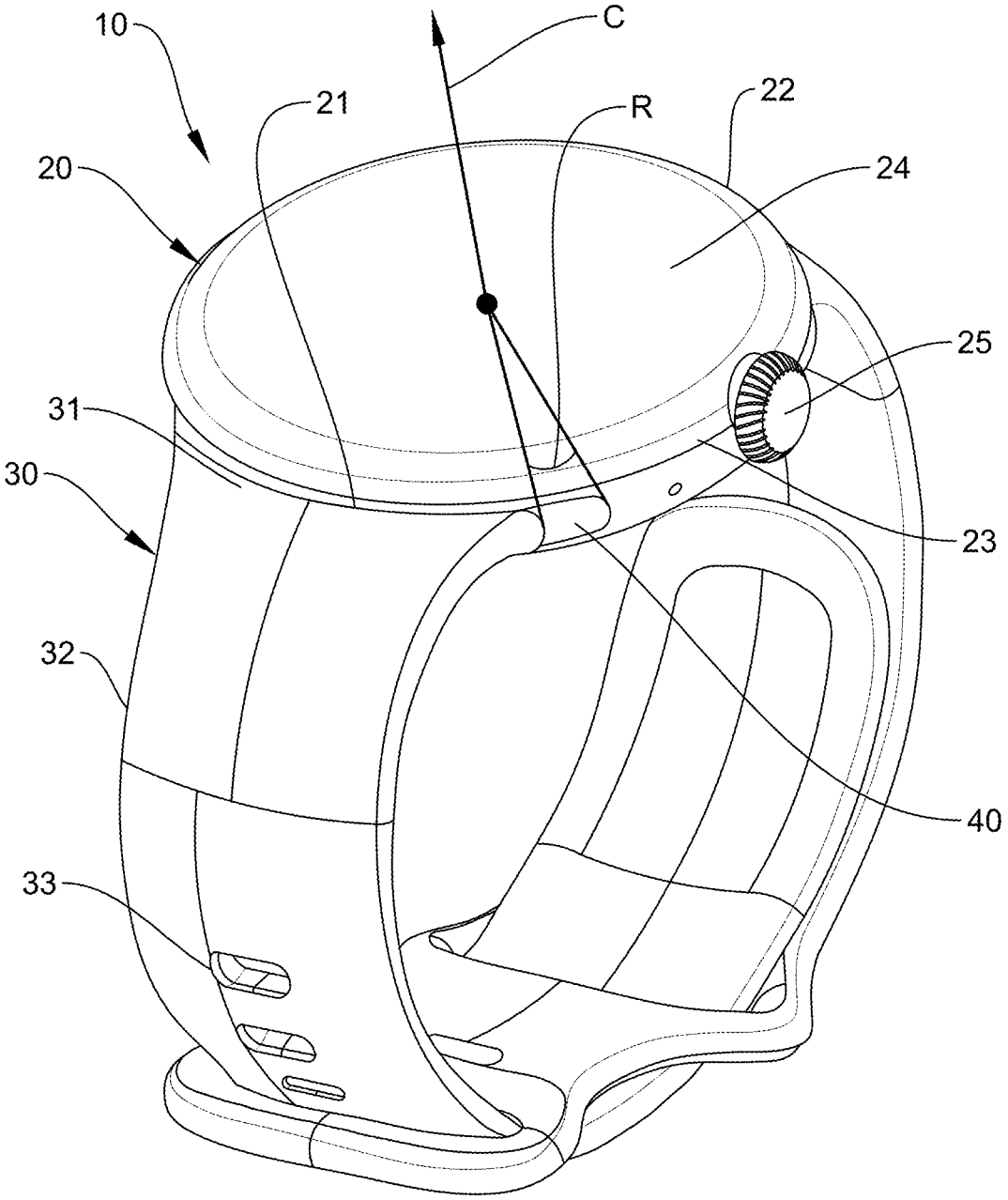
FIG. 1 shows a perspective view of a watch system, in accordance with aspects of the disclosure.

The present disclosure provides for a short throw engagement of an end of a removable watchband to a watch body in the form of a puck, in which the end of the watchband rotates about a central axis of the puck along an outer surface of the body and is retained by a set of teeth. As used herein, a "short throw engagement" is an engagement that takes a short relative movement between the end of the watchband and the puck to accomplish the coupling, such as less than a 20° rotation or less than a 5 mm horizontal translation. The end of the watchband is captured by a release button that is spring loaded to block the end of the watchband from moving in the reverse direction, only allowing release of the watchband when the button is pressed. These engagement mechanisms have a minimal impact on the internal volume of the puck, since the engagement of the end of the watchband only penetrates a small distance into the puck and follows the curvature of the outer surface of the puck. In one example, the end of the watchband only extends about 1.5 mm into the body in an arch shape that follows the round footprint and cross-sectional profile of the puck.

The engagement mechanism includes a series of teeth on the end of the watchband and within a connection interface of the puck. The teeth are spaced apart from one another and staggered, such that they overlap each other when the end of the watchband is moved in a drop and slide motion. This design distributes the teeth across the top and bottom surface of the connection interface, enabling them to be small but providing a strong and stable connection. It also keeps the engagement distance to a minimum, only 10 to 15 degrees of rotation in a round puck shape (about 3-4 mm for a square puck shape). Extra free play in the system can be reduced with a compressible or spring-loaded material pressing on the end of the watchband. The release button is compressed during the drop motion of the end of the watchband, and the release button automatically locks the end of the watchband when the end of the watchband is translated into an engaged position. Since the release button travel is orthogonal to the slide motion of the end of the watchband, the mechanism provides a secure lock. Release of the watchband requires a press of the release button and a slide of the end of the watchband over the release button to disengage the teeth from one another.

The connection interface shape is designed to be larger than the strap widths needed for the portion that extends around the wrist. In one example, this connection interface has a pill shape that wraps around a circumference of the puck by approximately 90 degrees. This design provides flexibility when using different watchband styles and materials. Some materials, like soft silicone rubber, can flow into the puck looking seamless. Other designs can include a more traditional metal watchband with a lot of material being used for a spring pin engagement between the wrist strap and the end of the watchband. The shape of the end of the watchband can also overlap the pill-shaped interface due to the drop and slide motion, so that only a small gap is needed between the overlap area of the end of the watchband and the puck.

Figure 2:
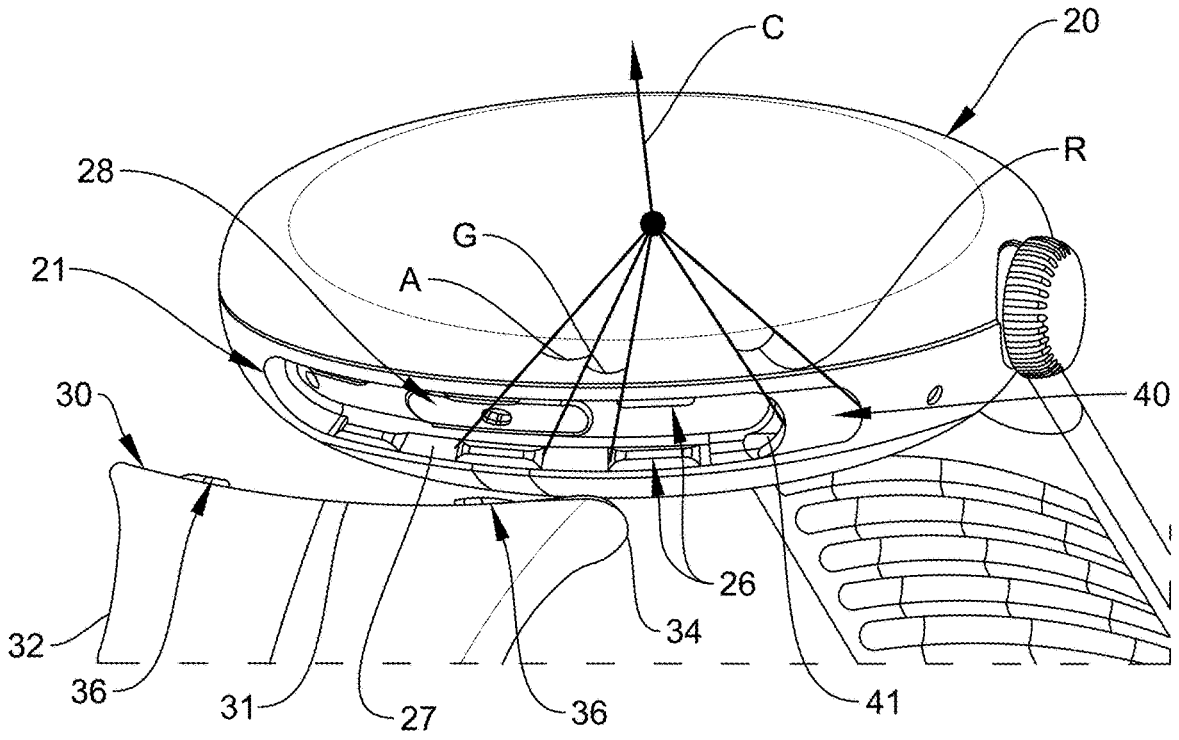
FIG. 2 shows a perspective view of the puck and watchband of FIG. 1, with the puck shown spaced apart from one side of the watchband.
Figure 3:
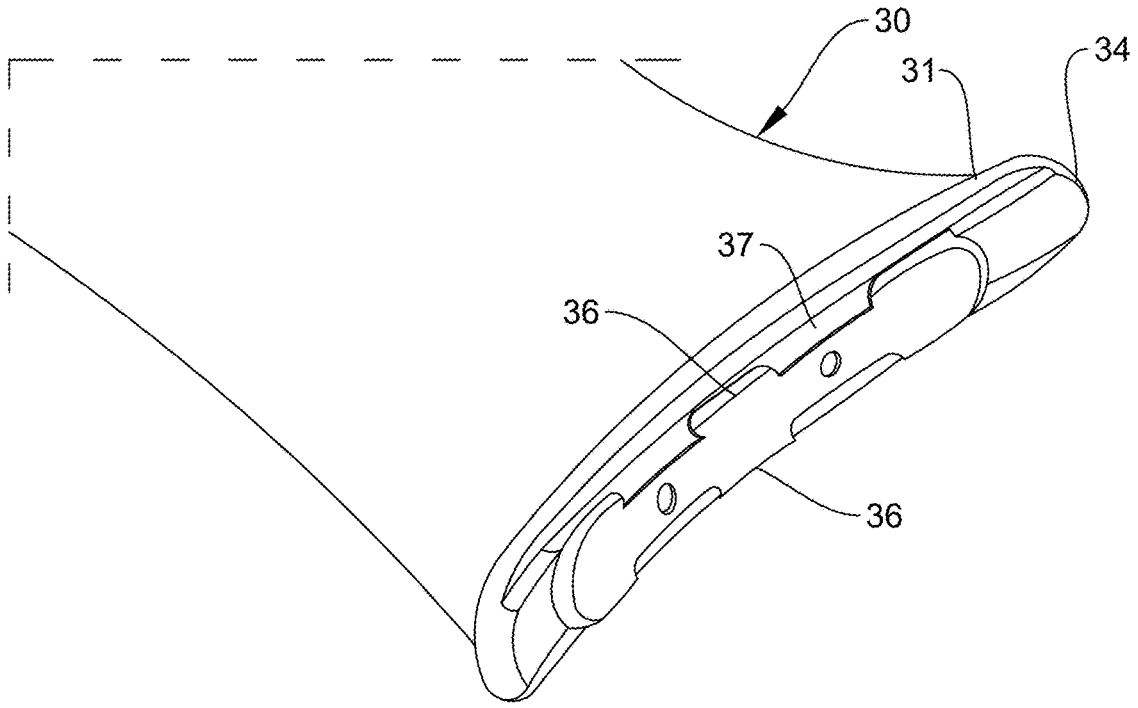
FIG. 3 shows a perspective view of one side of the watchband of FIG. 1.

Referring to FIGS. 1-3, an example watch system 10 includes a puck 20 engaged with a watchband 30. The example watch system 10 is shown as a smartwatch system, and the puck 20 is shown as an electronic watch that incorporates all of the smartwatch functionality (display, battery, sensors, etc.). However, in other examples, the watch system 10 may not be a smartwatch system, and the puck 20 may be a conventional watch that does not have any smartwatch functionality. The puck 20 includes a connection interface 21 that is coupled to an end 31 of the watchband 30.

In the examples shown, the puck 20 has first and second connection interfaces 21 that are removably coupled to respective first and second opposite ends 31 of the watchband 30. However, the coupling between the first connection interface 21 and the first end 31 of the watchband 30 and the coupling between the second connection interface and the second end of the watchband may be accomplished by the same or similar structures, so one set of the coupling structures will be described in detail below. As used herein, the first and second opposite ends 31 of the watchband 30 may be ends of two separate parts or bands that are fastened together to secure the watchband around the wrist of a user, or they may be opposite ends of a single unitary watchband that may stretch around the wrist of the user.

As shown in FIG. 2, the puck 20 includes an enclosure 22. An outer periphery 23 of the enclosure 22 is shown as having a circular shape, but in other examples, the outer periphery may have other shapes, including: an oval, an ellipse, a curvilinear shape, a square, a rhombus, a trapezoid, a rectangle, a combination thereof, or any other shape. The puck 20 may include one or more microelectronic devices inside of the enclosure 22, such as a microprocessor and memory. The puck 20 may include a display 24 that is configured to show output from the one or more microelectronic devices. The puck 20 may include a control wheel 25 that is configured to permit a user to control smartwatch functionality. The puck 20 may also contain a battery, sensors, and other functional smartwatch components therein (not shown).

The watchband 30 includes a wristband portion 32 that extends from the end 31 of the watchband. The end 31 of the watchband 30 may have a concave curved shape. The wristband portion 32 may be a flexible member configured to fit around a wrist of a user. The watchband 30 or the wristband portion 32 may be made of a flexible material, such as an elastomer. The watchband 30 may include closure elements such as a post (not shown) and a series of openings 33, the post being configured to be removably coupled to any corresponding one of the openings. Although the end 31 and the wristband portion 32 are shown as being two adjacent parts of a single unitary component, in other examples, the end 31 and the wristband portion 32 may be separate components coupled to one another via intermediate attachments.

The end 31 of the watchband 30 may be configured to be removably coupled to the puck 20 via the connection interface 21 that permits the watchband to be swapped with a simple release button press, translation, and rotation (e.g., about 10-15 degrees), as will be described below. The connection interface 21 may have a convex curved shape and may be a recessed portion of the enclosure 22. The connection interface 21 may have a curved recessed pill shape that wraps around a circumference of the enclosure 22 of the puck 20 by approximately 90 degrees.

The watch system 10 may have corresponding locking features that are configured to rotationally and translationally fix the puck 20 to the watchband 30. The corresponding locking features may be configured to be engaged when the watchband 30 is translated relative to the puck 20 and rotated about a central axis C of the puck by a predetermined rotation angle R, which may be 10-15 degrees.

The corresponding locking features of the watch system 10 may include a plurality of puck teeth 26 that are configured to be engaged with a corresponding plurality of watchband teeth 36, such that the puck teeth prevent the watchband teeth from translating away from the puck 20. Each of the puck teeth 26 and each of the watchband teeth 36 (when engaged with the puck teeth) may extend circumferentially about the central axis C of the puck 20 by a same angle A that is about equal to the predetermined rotation angle R.

Each of the puck teeth 26 may be separated from adjacent ones of the puck teeth by a puck gap 27, and each of the watchband teeth 36 may be separated from adjacent ones of the watchband teeth by a watchband gap 37. Each of the puck gaps 27 and each of the watchband gaps 37 (when the puck 20 and the watchband 30 are engaged) may extend circumferentially about the central axis C of the puck 20 by a same gap angle G that is about equal to the angle A and about equal to the predetermined rotation angle R.

In the embodiment shown, there are three pairs of puck teeth 26, each pair having a tooth at a top of the connection interface 21 and at a bottom of the connection interface, and there are also three pairs of watchband teeth 36, each pair having a tooth at a top of the end 31 of the watchband 30 and at a bottom of the end of the watchband. In other examples any number of pairs of puck teeth and watchband teeth may be used, and adjacent ones of the pick teeth and watchband teeth may extend about the central axis C by different angles A and may be separated from one another by different gap angles G.

The corresponding locking features may include a release button 40 adjacent to the connection interface 21 of the puck 20. The release button 40 may permit the end 31 of the watchband 30 to be removably retained within the connection interface 21 of the puck 20. When the end 31 of the watchband 30 is engaged with the connection interface 21 of the puck 20, a side surface 41 of the release button 40 may abut a side surface 34 of the end of the watchband 30, such that the release button prevents the end of the watchband from rotating relative to the puck 20. A closest pair of the puck teeth 26 is spaced apart from the surface 41 of the release button 40 by the same gap angle G. For example, the predetermined rotation angle R, the angle A, and the gap angle G may each be between about 5° and about 20°.

Figure 6:
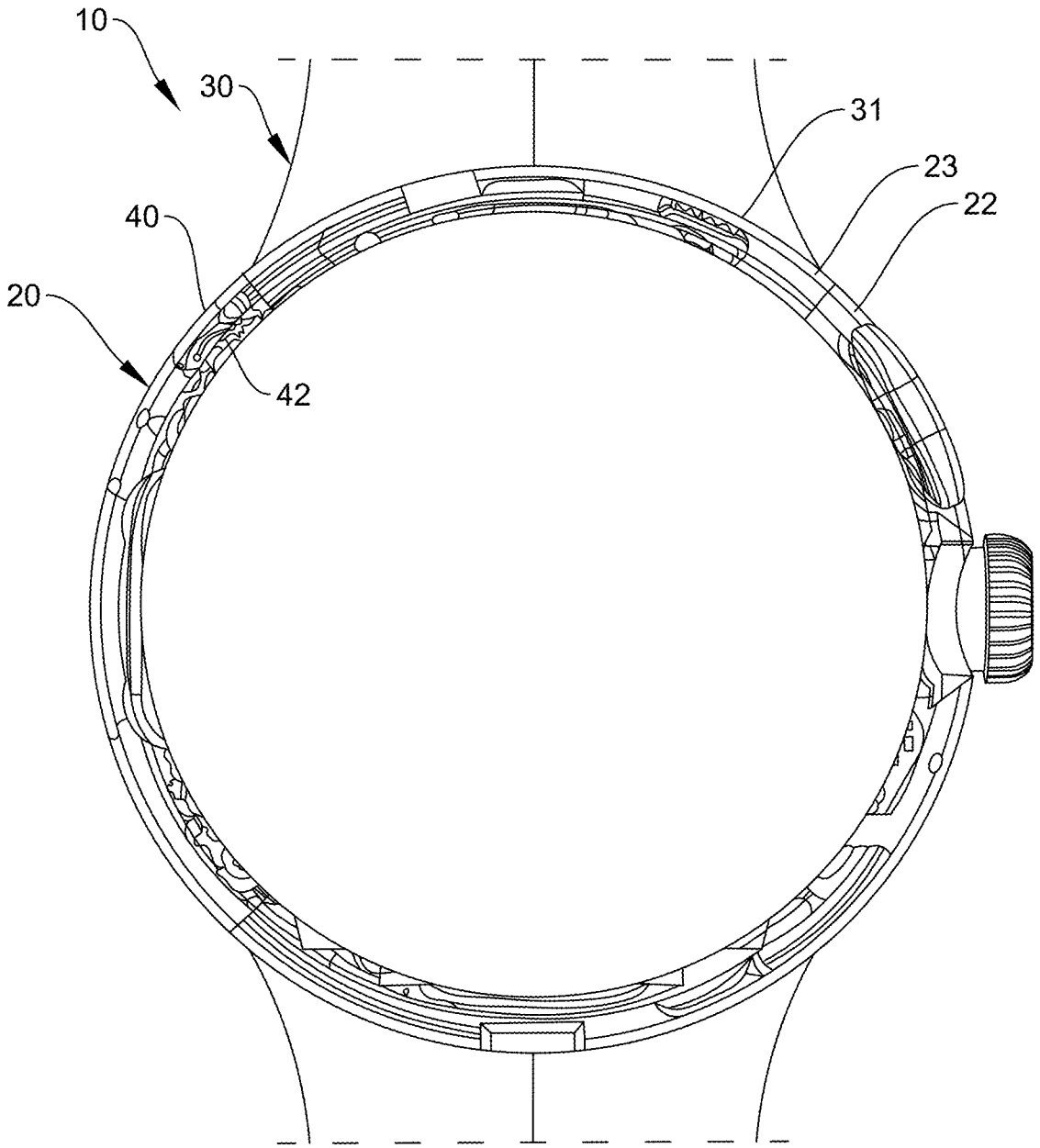
FIG. 6 shows a partially transparent top plan view of the watch system of FIG. 1.

To keep the release button 40 in an extended position in which the side surface 41 is exposed within the connection interface 21 (as shown in FIG. 2), the release button may be biased towards the extended position. To provide the position bias for the release button 40, the release button may be coupled to the enclosure 22 via a spring element 42 (FIG. 6). The spring element 42 is shown in the figures as a coil spring, but any other energy storage element may be used (e.g., a leaf spring, a piece of a memory metal, or a piece of any other material (e.g., a flexible polymer) that can store energy when compressed. In some examples, the release buttons 40 may themselves be made of memory metal or another energy storage element (e.g., a flexible polymer) that may be compressed by an external force and restore to its initial position when the external force is removed.

Figure 4:
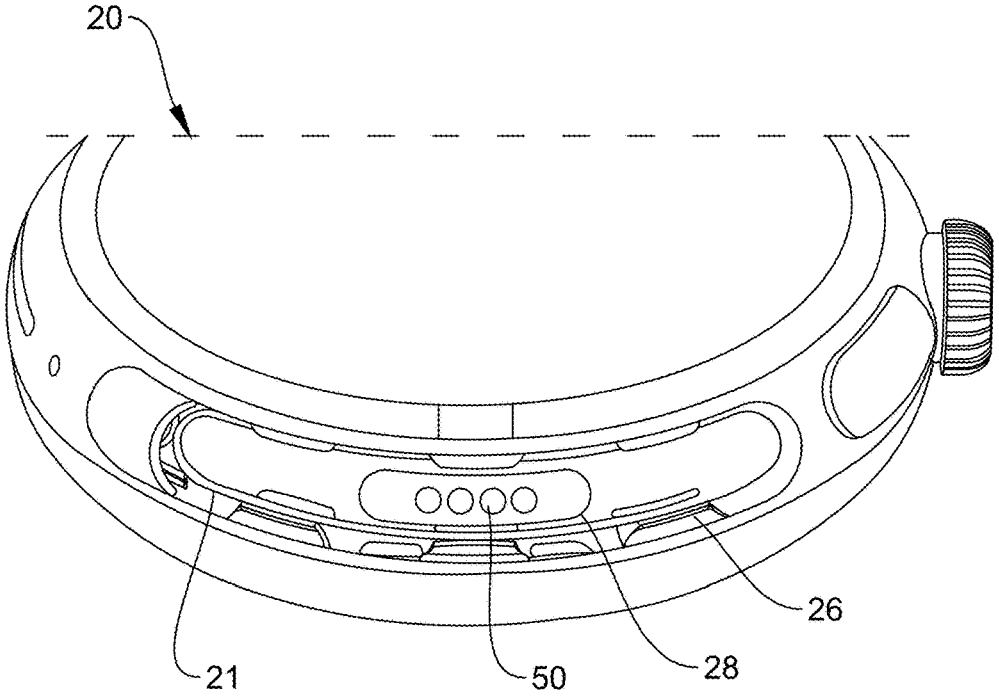
FIG. 4 shows a bottom perspective view of a first side of the puck of FIG. 1.
Figure 5:
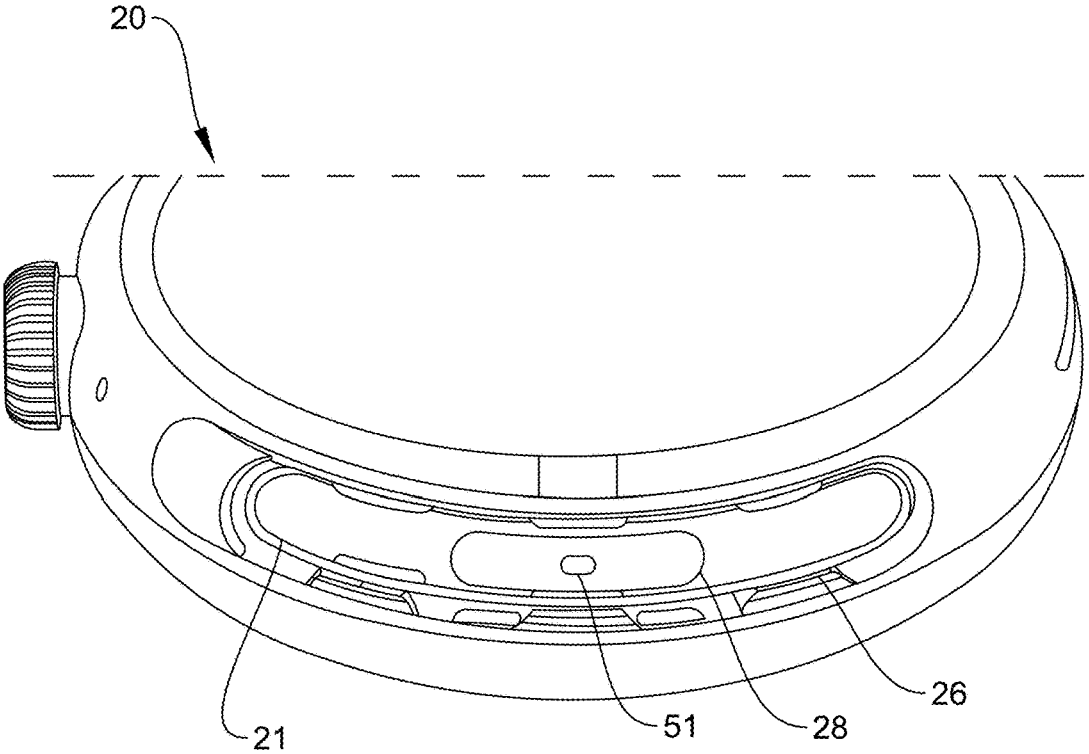
FIG. 5 shows a bottom perspective view of a second side of the puck of FIG. 1.

As shown in FIGS. 4 and 5, the puck 20 may also include a spring element 28 disposed within the connection interface 21, the spring element being configured to push the end 31 of the watchband 30 away from the puck, so that the watchband teeth 26 will apply a continual force against the puck teeth 36. This spring element 28 may permit the watch system 10 to achieve a tighter coupling between the puck 20 and the watchband 30, without a slight movement or rattling within the connection interface 21. Any energy storage element may be used for the spring element 28 (e.g., a leaf spring, a piece of a memory metal, or a piece of any other material (e.g., a flexible polymer) that can store energy when compressed.

A portion of the spring element 28 may be used for a functional feature of the watch system 10. For example, in the first connection interface 21 shown in FIG. 4, a debugging electrical port 50 is disposed in a center of the first spring element 28, and in the second connection interface shown in FIG. 5, a barometer opening 51 is disposed in the center of the second spring element.

FIG. 6 shows how the engagement mechanisms between the puck 20 and the watchband 30 have a minimal impact on the internal volume of the puck, since the engagement of the end 31 of the watchband only penetrates a small distance into the puck and follows the curvature of the outer periphery 23 of the enclosure 22. In the example shown in FIG. 6, the end 31 of the watchband 30 only extends about 1.5 mm into the enclosure 22 of the puck 20 in an arch shape that follows the round footprint and cross-sectional profile of the puck.

With the aforementioned configuration of teeth 26, 36, gaps 27, 37, and the release button 40, the watchband 30 may be removably coupled to the puck 20. This engagement between the watchband 30 and the puck 20 will be described further below with reference to FIGS. 7 and 8.

Figure 8:
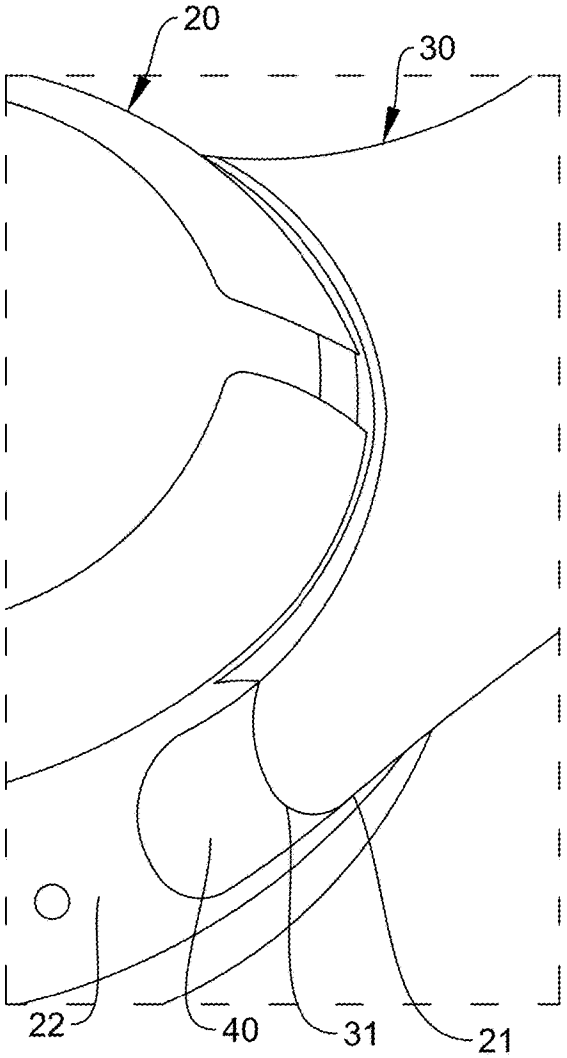
FIG. 8 shows a bottom perspective view of the watchband of FIG. 1 in a final rotational configuration relative to the puck after engagement.
Figure 7:
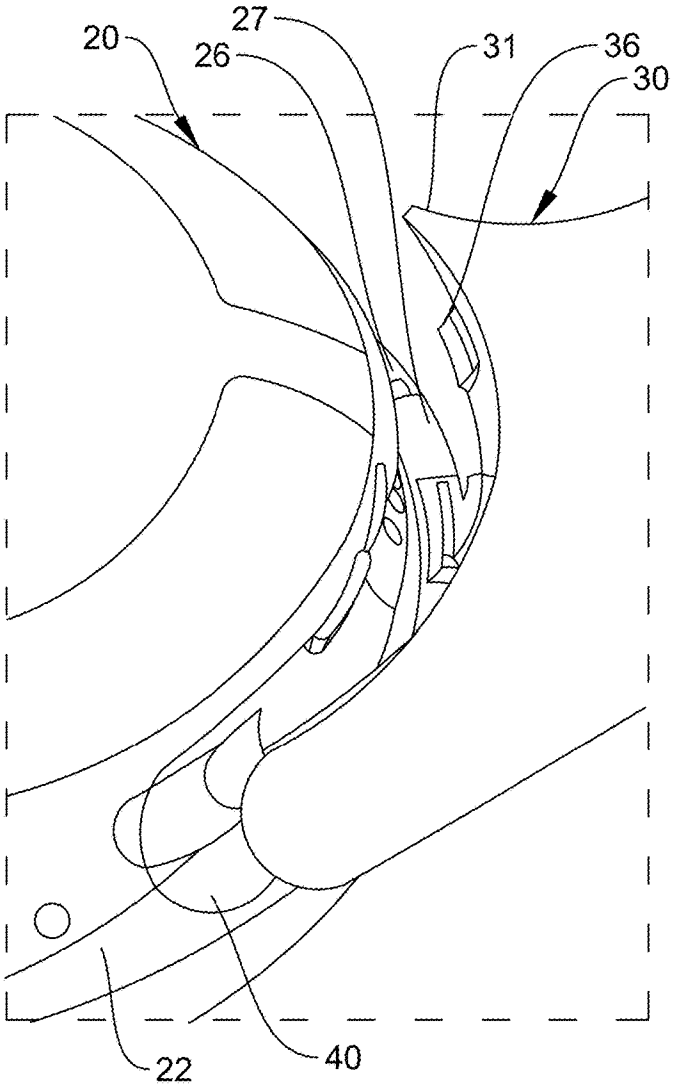
FIG. 7 shows a bottom perspective view of the watchband of FIG. 1 in an initial rotational configuration relative to the puck before engagement.

Referring to FIGS. 7 and 8, a method of engagement of the watchband 30 into the puck 20 will now be described. FIG. 7 shows the watchband 30 and the puck 20 in an initial rotational configuration, in which the watchband is offset from its final rotational configuration relative to the puck by about 10°-15°. In this initial rotational configuration, the watchband teeth 36 are rotationally aligned with corresponding gaps 27 between adjacent ones of the puck teeth 26.

The end 31 of the watchband 30 may then be translated horizontally into the connection interface 21, which will depress the release button 40 from its initial extended position to a depressed position in which the side surfaces of the release button are disposed within the enclosure 22.

Next, the watchband 30 may be rotated (clockwise from a top viewpoint in the examples shown) relative to the puck 20 by about 10°-15°. During this rotation, the watchband teeth 36 slide behind the puck teeth 26 until one side of the end 31 of the watchband 30 abuts a confronting end of the connection interface 21. At this point, the watchband teeth 36 are rotationally aligned with corresponding ones of the puck teeth 26, thereby translationally locking the watchband 30 relative to the puck 20 due to the horizontal interference between the watchband teeth and the puck teeth in a radial direction relative to the central axis C.

Also at this point, the end 31 of the watchband 30 has rotated completely off of the release button 40. Due to the spring bias of the release button 40, the release button automatically moves from the depressed position to its extended position, and the side surface 41 of the release button abuts the side surface 34 of the end 31 of the watchband 30, thereby rotationally locking the watchband 30 relative to the puck 20 in a circumferential direction about the central axis C. As the rotating of the end 31 of the watchband 30 slides the end of the watchband over the spring element 28 within the connection interface 21, the spring element may apply a force against the end of the watchband in a direction away from the puck 20, so that the watchband teeth 36 will apply a continual force against the puck teeth 26, thereby tightening the coupling.

Once these steps are completed, the watch system 10 is in an engaged configuration in which the end of the watchband 30 is rotationally locked relative to the puck 20 by interference between the side surface 34 of the end 31 of the watchband 30 and a side surface 41 of the release button 40, and in which the end of the watchband is translationally locked relative to the puck by interference between the wristband teeth 36 and corresponding ones of the puck teeth 26.

When a user desires to swap the watchband 30 for one with a different color, material, or functionality, the user may remove the watchband from the puck 20 as will be described below. For example, a user may wish to change the watchband 30 from a right-handed one to a left-handed one.

The user may remove the watchband 30 from the puck 20 by depressing the release button 40 using a finger, for example, so that the side surface 41 of the release button 40 slides into the enclosure 22 and no longer abuts the side surface 34 of the end 31 of the watchband 30. Once the button 40 has been depressed towards the puck 20, the watchband 30 may be rotated by about 10°-15° relative to the puck in the opposite direction that was used to couple the watchband to the puck (counterclockwise from a top viewpoint in the examples shown). This rotation will rotationally align the watchband teeth 36 with the openings 27 between adjacent ones of the puck teeth 26, so that the user may translate the watchband 30 out of the connection interface 21, to return the watchband and the puck 20 to the spaced-apart positions shown in FIG. 2.

The design of the watch system 10 shown in FIGS. 1-8 is just one example of the watch system. Other configurations of the watch system 10 are contemplated, such as watch systems having pucks and watchbands made of different materials, or having different sizes, thicknesses, or functions.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible implementations. Further, the same reference numbers in different drawings can identify the same or similar elements.

The invention claimed is:

1. A watch system, comprising:

a watchband comprising a flexible member configured to be mounted onto a wrist of a user, the watchband having an end that has a concave curved shape; and a puck including watch functionality, the puck having a connection interface that has a convex curved shape, the connection interface configured to be removably coupled to the end of the watchband;

wherein the watchband and the puck have corresponding locking features that are configured to rotationally and translationally fix the puck to the watchband, the corresponding locking features configured to be engaged when the watchband is translated relative to the puck and rotated about a central axis of the puck by a predetermined rotation angle.

2. The watch system of claim 1, wherein the corresponding locking features include a plurality of watchband teeth that are configured to be engaged with a corresponding plurality of puck teeth, such that the puck teeth prevent the watchband teeth from translating away from the puck.

3. The watch system of claim 2, wherein each of the puck teeth extends circumferentially about the central axis of the puck by a same angle, and the same angle is about equal to the predetermined rotation angle.

4. The watch system of claim 2, wherein the corresponding locking features include a release button adjacent to the connection interface of the puck, the release button being configured to abut a side surface of the end of the watchband, such that the release button prevents the end of the watchband from rotating relative to the puck.

5. The watch system of claim 4, wherein the watch system has an engaged configuration in which the end of the watchband is rotationally locked relative to the puck by interference between the side surface of the end of the watchband and a side surface of the release button, and in which the end of the watchband is translationally locked relative to the puck by interference between the wristband teeth and corresponding ones of the puck teeth.

6. The watch system of claim 4, wherein the release button is biased by a spring element towards an extended position in which the release button abuts the side surface of the end of the watchband, so that the release button is configured to automatically move from a depressed position within the puck to the extended position when the end of the watchband is moved off of the release button.

7. The watch system of claim 1, further comprising a spring element disposed within the connection interface, the spring element being configured to push the end of the watchband away from the puck, so that the watchband teeth apply a continual force against the puck teeth.

8. The watch system of claim 1, wherein the end is a first end and the connection interface is a first connection interface, the watchband further includes a second end that has a concave curved shape and a second connection interface that has a convex curved shape, and the second connection interface is configured to be removably coupled to the second end of the watchband.

9. The watch system of claim 1, wherein the predetermined rotation angle is between about 5° and about 20°.

10. The watch system of claim 1, wherein the puck has smartwatch features including a display, sensors, and a battery.

11. A method of removably coupling a watchband to a puck, the puck having watch functionality, the method comprising:

providing the watchband comprising a flexible member configured to be mounted onto a wrist of a user, the watchband having an end that has a concave curved shape;

translating the end of the watchband towards the puck until the end of the watchband contacts a connection interface of the puck, the connection interface having a convex curved shape;

rotating the end of the watchband about a central axis of the puck in a first rotational direction by a predetermined rotation angle; and engaging corresponding locking features of the watchband and the puck during the translating and the rotating of the end of the watchband, the corresponding locking features rotationally and translationally fixing the watchband to the puck.

12. The method of claim 11, wherein the translating of the end of the watchband includes inserting the end of the watchband into the connection interface of the puck, such that a plurality of watchband teeth moves between a corresponding plurality of puck teeth.

13. The method of claim 12, wherein the rotating of the end of the watchband includes aligning the plurality of the watchband teeth with the corresponding plurality of puck teeth, such that the puck teeth prevent the watchband teeth from translating away from the puck.

14. The method of claim 13, wherein each of the puck teeth extends circumferentially about the central axis of the puck by a same angle, and the same angle is about equal to the predetermined rotation angle.

15. The method of claim 13, wherein the translating of the end of the watchband includes the end of the watchband contacting and depressing a release button adjacent to the connection interface of the puck, and the rotating of the end of the watchband includes moving the end of the watchband off of the release button so that the release button automatically moves to an extended position in which the release button abuts a side surface of the end of the watchband, such that the release button prevents the end of the watchband from rotating relative to the puck.

16. The method of claim 15, wherein after the rotating of the end of the watchband, the watch system is in an engaged configuration in which the end of the watchband is rotationally locked relative to the puck by interference between the side surface of the end of the watchband and a side surface of the release button, and in which the end of the watchband is translationally locked relative to the puck by interference between the wristband teeth and corresponding ones of the puck teeth.

17. The method of claim 15, further comprising detaching the watchband from the puck, the detaching including:

depressing the release button so that the side surface of the release button no longer abuts the side surface of the end of the watchband;

rotating the end of the watchband relative to the puck in a second rotational direction opposite the first rotational direction by the predetermined rotation angle; and translating the end of the watchband away from the puck until the end of the watchband is withdrawn from the connection interface of the puck.

18. The method of claim 11, further comprising, after rotating the end of the watchband, a spring element disposed within the connection interface pushing the end of the watchband away from the puck, so that the watchband teeth apply a continual force against the puck teeth.

19. The method of claim 11, wherein the predetermined rotation angle is between about 5° and about 20°.

20. The method of claim 11, wherein the puck has smartwatch features including a display, sensors, and a battery.

* * * * *